US006085366A

United States Patent [19]

Pondelick et al.

[11] Patent Number: 6,085,366

[45] Date of Patent: Jul. 11, 2000

[54] APPARATUS FOR SUPPLYING PRESSURIZED RINSE WATER TO A TOILET

[75] Inventors: Mark Pondelick; Arthur J. McGowan, Jr., both of Roscoe, Ill.

[73] Assignee: Evac International OY, Helsinki, Finland

[21] Appl. No.: 09/347,164

[22] Filed: Jul. 2, 1999

[51] Int. Cl.[7] ..... E03D 11/00

[52] U.S. Cl. ..... 4/431; 4/434; 4/432; 4/435; 4/321

[58] Field of Search ..... 4/431, 432, 433, 4/434, 435, 300, 321, 332, 362, 334, 363

[56] References Cited

U.S. PATENT DOCUMENTS

| | | | |
|---|---|---|---|
| 3,405,645 | 10/1968 | Jackson | 103/152 |
| 3,533,387 | 10/1970 | Kaneko | 123/139 |
| 3,955,901 | 5/1976 | Hamilton | 417/395 |
| 3,996,628 | 12/1976 | Mollerstedt | 4/26 |
| 4,510,629 | 4/1985 | Jovy et al. | 4/332 |
| 4,690,621 | 9/1987 | Swain | 417/313 |
| 4,713,847 | 12/1987 | Oldfelt et al. | 4/431 |
| 5,326,234 | 7/1994 | Versaw et al. | 417/393 |
| 5,369,811 | 12/1994 | Serre | 4/431 |
| 5,406,652 | 4/1995 | Hennessy | 4/354 |
| 5,445,356 | 8/1995 | Walsh et al. | 251/5 |
| 5,487,193 | 1/1996 | Hennessy | 4/328 |
| 5,593,290 | 1/1997 | Griesch et al. | 417/478 |
| 5,604,938 | 2/1997 | Tyler | 4/431 |
| 5,732,417 | 3/1998 | Pondelick et al. | 4/431 |
| 5,754,987 | 5/1998 | Johansson et al. | 4/431 |
| 5,983,414 | 11/1999 | Lindroos et al. | 4/431 |
| 6,006,373 | 12/1999 | Hoang | 4/431 |

*Primary Examiner*—Steven O. Douglas
*Assistant Examiner*—Khoa Huynh
*Attorney, Agent, or Firm*—Marshall, O'Toole, Gerstein, Murray & Borun

[57] ABSTRACT

Apparatus for pressurizing rinse fluid to a toilet is provided comprising a reservoir for receiving gravity fed rinse fluid. The reservoir is connected to a source of pressurized air through an air inlet valve mechanically coupled to a controller. A rinse fluid discharge valve is connected to an outlet of the reservoir and is operatively connected to the controller. When triggered, the controller allows pressurized air to enter the reservoir, thereby pressurizing the rinse fluid contained therein. The controller then opens the rinse fluid discharge valve to deliver the pressurized rinse fluid to the toilet. The controller and rinse fluid discharge valves are preferably pneumatically operable so that a separate power source is not required for the pressurized rinse fluid apparatus.

19 Claims, 1 Drawing Sheet

APPARATUS FOR SUPPLYING PRESSURIZED RINSE WATER TO A TOILET

FIELD OF THE INVENTION

The present invention generally relates to vacuum toilet systems, and more particularly to apparatus for supplying pressurized water to a vacuum toilet.

BACKGROUND OF THE INVENTION

Vacuum toilet systems are widely used in various applications such as trains and marine vessels, in place of standard, gravity operated toilets found in most homes. Instead of using gravity drainage piping, the toilet discharge is connected to a vacuum source which pulls waste material through a discharge pipe to a collection tank. A waste-receiving bowl is attached to the discharge pipe, and a discharge valve disposed in the discharge pipe controls when a vacuum is present in the bowl. One or more nozzles for dispensing rinse fluid are typically located around a rim of the waste-receiving bowl.

To provide a more complete rinse, it is desirable to use fluid that is under pressure. Pressurized water is not always available on trains or marine applications, but pressurized air generally is. Accordingly, one type of device is known which uses pressurized air to provide pressurized rinse water. This device has a diaphragm disposed inside a reservoir and movable between first and second positions. A spring pushes the diaphragm to the first position which allows a large volume of water to enter the reservoir. Pressurized air is then used to overcome the force of the spring and push the diaphragm to the second, compressed position. The diaphragm in the second position pressurizes the water in the chamber to a pressure equal to that of the incoming air. The pressurized water flows out of the reservoir to rinse the bowl. A similar device uses vacuum instead of the return spring to move the diaphragm to the first position. The water pressurizers having diaphragms are overly costly and difficult to assemble.

Another type of water pressurizer uses a controller and electronically operated solenoid valves. A solenoid valve is used to control communication between the source of pressurized air and the reservoir so that, when the valve is opened, the fluid in the reservoir is pressurized. Another solenoid valve is used to control discharge of the pressurized fluid from the reservoir. Additional solenoid valves may be used to provide other functions such as controlling when unpressurized water is delivered to the reservoir. These water pressurizing systems require a power source to operate and requires components which are overly expensive.

SUMMARY OF THE INVENTION

In accordance with certain aspects of the present invention, apparatus is provided for supplying pressurized rinse water to a toilet bowl. The apparatus is adapted for use with a supply of rinse water, the rinse water being gravity fed to the apparatus, and a source of pressurized air. The apparatus comprises an enclosed reservoir. A rinse fluid inlet branch is attached to the reservoir and in fluid communication with the supply of rinse fluid. A rinse fluid inlet valve is disposed in the rinse fluid inlet branch and is normally open but automatically operable to close, thereby preventing fluid flow out of the reservoir. A vent branch is attached to the reservoir and open to atmosphere, and a vent discharge valve disposed in the vent branch and operable between open and closed positions. An air inlet branch is attached to the reservoir and in fluid communication with the source of pressurized air. An air inlet valve disposed in the air inlet branch and operable between open and closed positions. A rinse fluid outlet branch is attached to the reservoir and in fluid communication with the toilet bowl, while a rinse fluid discharge valve is disposed in the rinse fluid outlet branch and operable between open and closed positions. Finally, a controller is provided for selectively operating the vent discharge valve, air inlet valve, and rinse fluid outlet valve. The vent valve is normally open and the air inlet valve and rinse fluid outlet valve are normally closed to allow the reservoir to fill with rinse fluid. The controller is triggerable to move the vent discharge valve to the closed position and move the air inlet valve to the open position to thereby pressurize the rinse fluid in the reservoir. The controller also moves the rinse fluid discharge valve to the open position to send the pressurized rinse fluid to the toilet bowl.

In accordance with additional aspects of the present invention, a vacuum toilet is provided for use with a supply of rinse fluid, the supply of rinse fluid being gravity fed to the vacuum toilet, and a source of pressurized air. The toilet comprises a bowl for receiving waste material and having an outlet, a vacuum source connected to the outlet of the bowl by a sewer pipe, and a waste discharge valve disposed in the sewer pipe and operable between open and closed positions. The toilet further has an enclosed reservoir with a rinse fluid inlet branch attached to the reservoir and in fluid communication with the supply of rinse fluid. A rinse fluid inlet valve is disposed in the rinse fluid inlet branch and is normally open but automatically operable to close, thereby preventing fluid flow out of the reservoir. A vent branch is attached to the reservoir and open to atmosphere, with a vent discharge valve being disposed in the vent branch and operable between open and closed positions. An air inlet branch is also attached to the reservoir and in fluid communication with the source of pressurized air, while an air inlet valve is disposed in the air inlet branch and operable between open and closed positions. A rinse fluid outlet branch is attached to the reservoir and in fluid communication with the toilet bowl. A rinse fluid discharge valve disposed in the rinse fluid outlet branch and operable between open and closed position. Finally, a controller is provided for selectively operating the vent discharge valve, air inlet valve, rinse fluid outlet valve, and waste discharge valve. The vent discharge valve is normally open and the air inlet valve, the rinse fluid outlet valve, and the waste discharge valve are normally closed to allow the reservoir to fill with rinse fluid. The controller is triggerable to move the vent discharge valve to the closed position and move the air inlet valve to the open position to thereby pressurize the rinse fluid in the reservoir. The controller also moves the rinse fluid discharge valve to the open position to send the pressurized rinse fluid to the toilet bowl and the waste discharge valve to the open position to evacuate the bowl.

In accordance with still further aspects of the present invention, apparatus is provided for supplying pressurized water to a bowl of a toilet. The apparatus is adapted for use with a supply of water, the supply of water being gravity fed to the apparatus, and a source of pressurized air. The apparatus comprises an enclosed reservoir having a water inlet branch attached to the reservoir and in fluid communication with the supply of water. A first check valve is disposed in the water inlet branch and oriented to allow water flow into the reservoir while preventing water flow out of the reservoir. A three-way valve is provided having a first port attached to the reservoir by a dual-function branch, a second port open to atmosphere, and a third port in fluid communication with the source of pressurized air. A valve member of the three-way valve is operable between a normal position which establishes communication between the first port and the second port and an actuated position which establishes communication between the first port and the third port. A second check valve is disposed in the dual-function branch and oriented to allow air flow out of the reservoir while preventing water flow out of the reservoir. The apparatus further includes a water outlet branch attached to the reservoir and in fluid communication with the toilet bowl, with a water discharge valve disposed in the rinse fluid outlet branch and operable between open and closed positions. Finally, a controller is provided for selectively operating the three-way valve and water outlet valve. The three-way valve is initially in the normal position and the water outlet valve is normally in the closed position to allow the reservoir to fill with water, the controller being triggerable to move the three-way valve to the actuated position to thereby pressurize the rinse fluid in the reservoir. The controller also moves the water discharge valve to the open position to send the pressurized water to the toilet bowl.

DETAILED DESCRIPTION OF THE PREFERRED EMBODIMENTS

Figure 1:
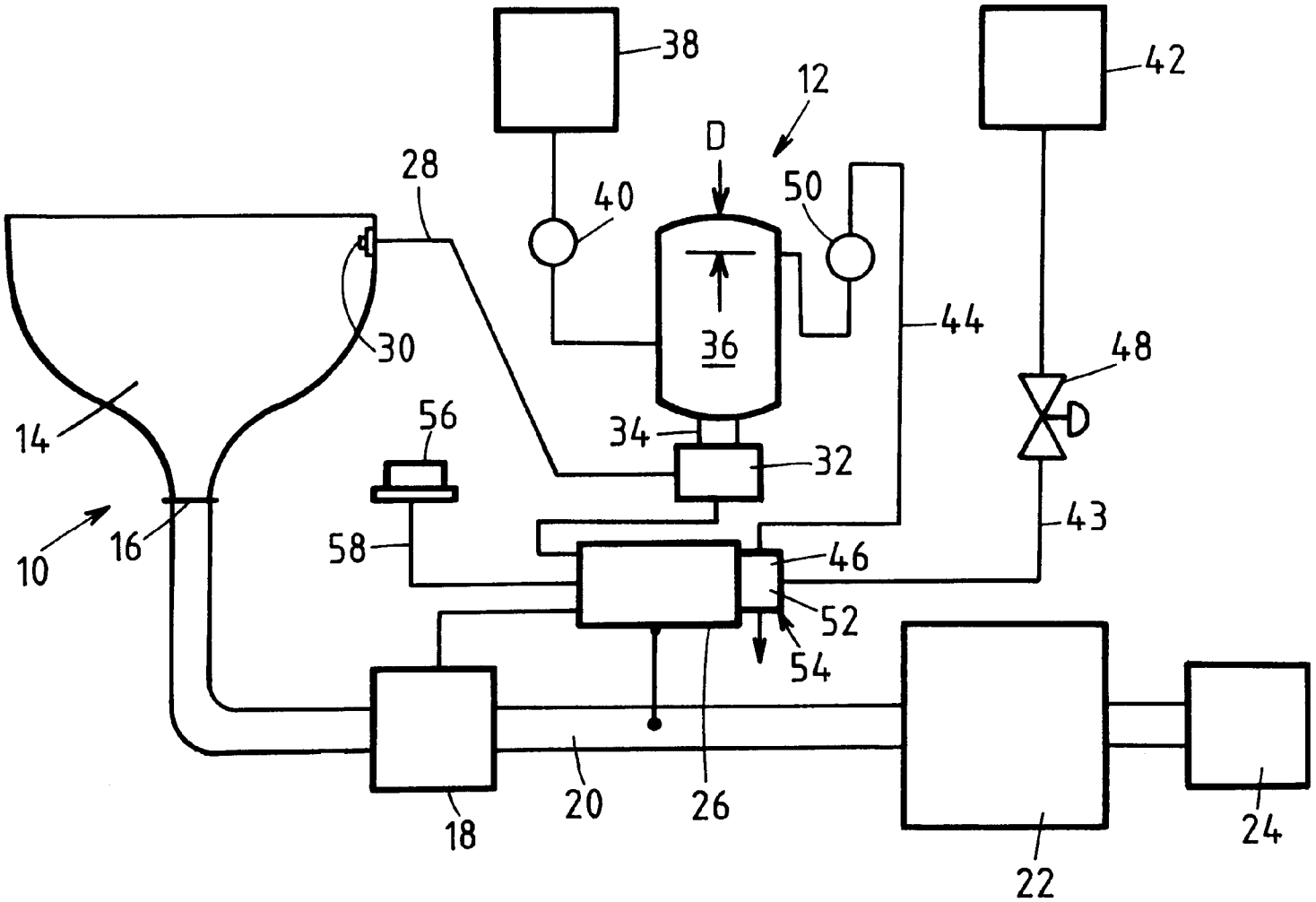
FIG. 1 schematically illustrates apparatus for pressurizing water incorporated in a vacuum toilet system in accordance with the present invention.

A vacuum toilet 10 incorporating apparatus for pressurizing rinse water 12 is schematically illustrated in FIG. 1. As used herein, rinse water includes water or any other type of fluid, provided separately or mixed with water, used to rinse a toilet. The vacuum toilet 10 illustrated at FIG. I and described below is intended for installation in a train, but the present invention may also be adapted for use in other applications, including different types of mobile structures (such as marine vessels), and stationary building structures.

The vacuum toilet 10 includes a waste-receiving bowl 14 defining an interior space for receiving waste material. The bowl 14 has an outlet opening 16 connected to an upstream side of a waste discharge valve 18. A downstream side of the waste discharge valve 18 is connected to a sewer pipe 20 which leads to a collection tank 22. A vacuum source, such as a pump 24, is connected to the connection tank 22 to create a vacuum therein. A controller 26 operates the waste discharge valve 18 to selectively establish a vacuum in the bowl 14 to thereby transport waste material from the bowl 14 to the collection tank 22.

The rinse water pressurizing apparatus 12 comprises a rinse water tube 28 extending to the bowl 14. A nozzle 30 is attached to the end of the rinse water tube 28 inside the bowl 14 to produce a spray pattern which covers the interior of the bowl 14. While FIG. 1 illustrates only one rinse water tube 28 and nozzle 30, a plurality of individual rinse water tubes and nozzles may be provided about the interior of the bowl 14. In the alternative, a single rinse water tube leading to a spray ring extending about the interior of the bowl 14 may be used. The rinse water tube 28 is connected to a water discharge valve 32 operatively connected to the controller 26. The water discharge valve 32 is connected by a water outlet branch 34 to a reservoir 36 for holding rise water. As described in greater detailed below, the water discharge valve 32 is operated to discharge water from the reservoir and through the rinse water tube 28 to the bowl 14. In the alternative, a spring loaded check valve may be used in place of the controller-operated water discharge valve 32. The spring of the check valve is selected with a spring force which allows the valve to open at a predetermined pressure, thereby supplying pressurized rinse water to the toilet 10.

A supply of water 38 is also connected to the reservoir 36. The water supply 38 is connected to a water inlet valve 40 which allows fluid flow in a single direction toward the reservoir 36. In a preferred embodiment, the water inlet valve 40 is a check valve. The water inlet valve 40 is connected by a water inlet branch to the reservoir 36. The water supply 38 is located above the reservoir 36 to provide gravity fed rinse water to the reservoir 36.

A source of pressurized air 42 is also connected to the reservoir 36 by an inlet tube 43 and an air inlet branch 44. The pressurized air source 42, which may provide air at pressures as high as 140 psi, is in fluid communication with an air inlet valve 46. A regulator 48 may be disposed between the pressurized air source 42 and the air inlet valve 46 to provide air at a desired pressure, typically approximately 40 psi. The air inlet valve 46 is operatively connected to the controller 26.

According to the currently preferred embodiment illustrated at FIG. 1, the air inlet branch 44 also doubles as a vent branch, to provide a dual-function branch. A vent valve 50 is disposed in the vent branch and is automatically operable to allow air flow out of the reservoir 36 while preventing water flow out of the reservoir 36 as the reservoir fills with water. The vent valve 50 is preferably a check valve having a buoyant float moveable between open and closed-valve positions. In the open-valve position, the float is spaced from a valve seat in the valve 50 so that air may flow therethrough. The vent valve 50 is positioned below a top edge of the reservoir 36 so that, as the reservoir 36 fills with water, the portion of the air inlet branch 44 extending between the reservoir 36 and vent valve 50 also fills with water. In a preferred embodiment, the vent valve 50 is positioned a distance "D" below the top of the reservoir 36 to allow for expansion of the rinse water due to freezing, so that the reservoir 36 does not crack in the event that the toilet 10 is exposed to cold temperatures. The rising water level in the air inlet branch 44 pushes the float toward the valve seat to close the vent valve 50, thereby preventing water flow out of the reservoir 36 and through the air inlet branch 44.

In the alternative, the vent branch may be provided separate from the air inlet branch. In this embodiment, the separate vent branch carries the vent valve 50 and a dedicated vent discharge valve, while the air inlet branch has a dedicated air inlet valve.

Returning to the illustrated embodiment, a vent discharge valve 52 is provided for controlling discharge of air vented from the reservoir 36 to atmosphere. In the currently preferred embodiment, the vent discharge valve 52 is integrally provided with the air inlet valve 46 to form a three-way valve 54. The three-way valve 54 has a first port connected to the air inlet branch 44, a second port connected to atmosphere, and a third port connected to the inlet tube 43. The three-way valve 54 has a valve member operable between a normal position, in which the valve establishes communication between the first and second ports (i.e., between the air inlet branch 44 and atmosphere), and an actuated position, in which the valve 54 establishes communication between the first port and the third port (i.e., between the inlet tube 43 and the air inlet branch 44). The three-way valve 54 is preferably operatively coupled to the controller 26, as described in greater detail below.

The controller 26 is preferably a pneumatic controller which utilizes vacuum present in the sewer pipe 20 to actuate valves connected thereto. The controller 26 is preferably similar to that sold by EVAC International as part number 57755 00. Accordingly, the controller 26 is responsive to a trigger, such as flush button 56. In the preferred embodiment, a tube 58 connects the flush button 56 to the controller 26. The flush button 56 is adapted to generate an increased pressure level in the tube 58 which triggers the controller 26 to activate the attached valves. The controller 26 transfers vacuum from the sewer pipe 20 to various internal chambers of the controller which are connected to the waste and water discharge valves 18, 32. For example, the controller 26 transfers vacuum to the waste discharge valve 18, which acts to open the waste discharge valve 18, thereby transporting any waste material in the bowl 14. Vacuum is also transferred to the water discharge valve 32 to open the valve, thereby discharging pressurized rinse water through the rinse water tube 28. Accordingly, it will be appreciated that the waste and water discharge valves 18, 32 are preferably pneumatically operable.

The controller 26 preferably includes an internal flexible diaphragm having a shaft attached thereto so that, when the controller 26 is triggered, the diaphragm and attached shaft are displaced. The three-way valve 54 is preferably attached to the controller 26 so that the shaft of the controller mechanically operates the valve member of the three-way valve 54. Accordingly, when the shaft is in a normal position, the valve member of the three-way valve 54 is also in the normal position which allows air in the reservoir 36 to vent to atmosphere through the air inlet branch 44. When the controller 26 is activated so that the shaft moves to a displaced position, the shaft moves the valve member of the three-way valve 54 to the actuated position, which shuts off the vent and establishes communication between the pressurized air source 42 and the air inlet branch 44.

Operation of the water pressurizer in particular will now be described. Initially, when the reservoir 36 is empty, the water discharge valve 32 is closed and the three-way valve 54 is positioned to allow air from the reservoir 36 to vent to atmosphere. Because the fluid level in the reservoir 36, and thus the portion of the air inlet branch 44 extending between the reservoir 36 and the vent valve 50, is below the float of the vent valve, the vent valve 50 is open. Water from the water supply 38 is allowed to flow through the water inlet valve 40 to collect in the reservoir 36. As the reservoir 36 fills, air displaced by the water vents through the air inlet branch 44, vent valve 50, and three-way valve 54 to discharge into atmosphere. When the water level in the reservoir 36 nears the top, the float of the vent valve 50 engages the valve seat to prevent passage of fluid through the vent valve 50. As a result, the flow of water from the water supply 38 ceases, since air may no longer be displaced by water in the reservoir 36. The apparatus for pressurizing rinse water 12 remains in this condition until the controller 26 is triggered. When the controller 26 is activated, the valve member of the three-way valve 54 moves to the actuated position which establishes communication between the pressurized air source 42 and the air inlet branch 44. The pressurized air overcomes the seating force of the float in the vent valve 50 to pressurize the water in the reservoir 36. The increased pressure in the reservoir 36 also forces the water inlet valve 40 closed. The controller 26 also opens the water discharge valve 32 so that the pressurized water exits the reservoir 36 and passes through the rinse water tube 28 to discharge into the bowl 14. The controller 26 opens the water discharge valve 32 approximately simultaneously as the three-way valve 54 is moved to the actuated position. The controller 26 may, however, delay opening the water discharge valve 32 for a period of time (e.g. 0.1 sec.) to ensure that the water in the reservoir 36 is pressurized. After a predetermined amount of time, the water valve shuts and the three-way valve again establishes communication between the air inlet branch 44 and atmosphere so that the same process may be repeated.

As the above process is carried out, waste material collected in the bowl 14 is discharged into the collection tank 22. The waste discharge valve 18 is also operatively connected to the controller 26 so that when the controller 26 is activated, the waste discharge valve 18 opens. When the waste discharge valve 18 is open, vacuum is established at a bottom portion of the bowl 14 while atmospheric pressure is present near the top of the bowl. The resulting pressure differential pushes any waste material in the bowl 14 through the waste discharge valve 18 and sewer pipe 20 to collect in the tank 22. In certain applications where a pool of rinse water in the toilet is desired (such as in many marine applications), the waste discharge valve 18 closes before the water discharge valve 32. In other applications, such as in most train applications, a pool of water is undesirable and therefore the waste discharge valve 18 remains open after the water discharge valve 32 closes so that rinse water discharged into the bowl 14 is also transported to the collection tank 22.

From the foregoing, it will be appreciated that the present invention brings to the art new and improved apparatus for pressurizing toilet rinse water. The apparatus includes a reservoir for receiving gravity fed rinse water from a water supply. The reservoir is also connected to an air vent and a pressurized air intake. A water discharge valve is attached to the reservoir for controlling discharge of rinse water to a toilet bowl. The water discharge valve is preferably pneumatically operated and a valve for controlling flow of pressurized air is preferably mechanically operated so that a power source is not required to supply pressurized rinse water to the bowl.

The foregoing detailed description has been given for clearness of understanding only, and no unnecessary limitations should be understood therefrom, as modifications would be obvious to those skilled in the art.

What is claimed is:

1. Apparatus for supplying pressurized rinse fluid to a bowl of a toilet, the apparatus adapted for use with a supply of rinse fluid, the supply of rinse fluid being gravity fed to the apparatus, and a source of pressurized air, the apparatus comprising:

an enclosed reservoir;

a rinse fluid inlet branch attached to the reservoir and in fluid communication with the supply of rinse fluid, a rinse fluid inlet valve disposed in the rinse fluid inlet branch being normally open, the rinse fluid inlet valve automatically operable to close, thereby preventing fluid flow out of the reservoir;

a vent branch attached to the reservoir and open to atmosphere, a vent discharge valve disposed in the vent branch and operable between open and closed positions;

an air inlet branch attached to the reservoir and in fluid communication with the source of pressurized air, an air inlet valve disposed in the air inlet branch and operable between open and closed positions;

a rinse fluid outlet branch attached to the reservoir and in fluid communication with the toilet bowl, a rinse fluid discharge valve disposed in the rinse fluid outlet branch and operable between open and closed positions; and a controller for selectively operating the vent discharge valve, air inlet valve, and rinse fluid outlet valve, wherein the vent discharge valve is normally open and the air inlet valve and the rinse fluid outlet valve are normally closed to allow the reservoir to fill with rinse fluid, the controller being triggerable to move the vent discharge valve to the closed position and move the air inlet valve to the open position to thereby pressurize the rinse fluid in the reservoir, the controller also moving the rinse fluid discharge valve to the open position to send the pressurized rinse fluid to the toilet bowl.

2. The apparatus of claim 1, in which the vent and air inlet branches are integrally provided as a dual-function branch.

3. The apparatus of claim 2, in which the vent discharge valve and air inlet valve are integrally provided as a three-way valve disposed in the dual-function branch.

4. The apparatus of claim 3, in which the controller has a shaft moveable between normal and actuated positions, and the three-way valve has a valve member mechanically actuated by the shaft.

5. The apparatus of claim 4, in which the toilet bowl has an outlet connected to a vacuum source, and in which the controller is a pneumatic controller operatively connected to the vacuum source.

6. The apparatus of claim 1, further comprising a check valve in the vent branch, the check valve automatically operable to allow air flow out of the reservoir while preventing rinse fluid flow out of the reservoir.

7. The apparatus of claim 6, in which the check valve includes a buoyant float sized to close the valve and movable between open and closed positions, the float having a density less than rinse fluid so that the float moves to the closed position as the rinse fluid level in a portion of the air vent branch between the reservoir and the check valve increases.

8. The apparatus of claim 1, in which the toilet bowl has an outlet connected to a vacuum source, and in which the controller is a pneumatic controller operatively connected to the vacuum source.

9. A vacuum toilet for use with a supply of rinse fluid, the supply of rinse fluid being gravity fed to the vacuum toilet, and a source of pressurized air, the toilet comprising:

a bowl for receiving waste material and having an outlet;

a vacuum source connected to the outlet of the bowl by a sewer pipe;

a waste discharge valve disposed in the sewer pipe and operable between open and closed positions;

an enclosed reservoir;

a rinse fluid inlet branch attached to the reservoir and in fluid communication with the supply of rinse fluid, a rinse fluid inlet valve disposed in the rinse fluid inlet branch being normally open, the rinse fluid inlet valve automatically operable to close, thereby preventing fluid flow out of the reservoir;

a vent branch attached to the reservoir and open to atmosphere, a vent discharge valve disposed in the vent branch and operable between open and closed positions;

an air inlet branch attached to the reservoir and in fluid communication with the source of pressurized air, an air inlet valve disposed in the air inlet branch and operable between open and closed positions;

a rinse fluid outlet branch attached to the reservoir and in fluid communication with the toilet bowl, a rinse fluid discharge valve disposed in the rinse fluid outlet branch and operable between open and closed positions; and a controller for selectively operating the vent discharge valve, air inlet valve, rinse fluid outlet valve, and waste discharge valve, wherein the vent discharge valve is normally open and the air inlet valve, the rinse fluid outlet valve, and the waste discharge valve are normally closed to allow the reservoir to fill with rinse fluid, the controller being triggerable to move the vent discharge valve to the closed position and move the air inlet valve to the open position to thereby pressurize the rinse fluid in the reservoir, the controller also moving the rinse fluid discharge valve to the open position to send the pressurized rinse fluid to the toilet bowl and the waste discharge valve to the open position to evacuate the bowl.

10. The vacuum toilet of claim 9, in which the vent and air inlet branches are integrally provided as a dual-function branch.

11. The vacuum toilet of claim 10, in which the vent discharge valve and air inlet valve are integrally provided as a three-way valve disposed in the dual-function branch.

12. The vacuum toilet of claim 11, in which the controller has a shaft moveable between normal and actuated positions, and the three-way valve has a valve member mechanically actuated by the shaft.

13. The vacuum toilet of claim 12, in which the controller is a pneumatic controller operatively connected to the vacuum source.

14. The vacuum toilet of claim 9, further comprising a check valve in the vent branch, the check valve automatically operable to allow air flow out of the reservoir while preventing rinse fluid flow out of the reservoir.

15. The vacuum toilet of claim 14, in which the check valve includes a buoyant float sized to close the valve and movable between open and closed positions, the float having a density less than rinse fluid so that the float moves to the closed position as the rinse fluid level in a portion of the air vent branch between the reservoir and the check valve increases.

16. Apparatus for supplying pressurized water to a bowl of a toilet, the apparatus adapted for use with a supply of water, the supply of water being gravity fed to the apparatus, and a source of pressurized air, the apparatus comprising:

an enclosed reservoir;

a water inlet branch attached to the reservoir and in fluid communication with the supply of water, a first check valve disposed in the water inlet branch and oriented to allow water flow into the reservoir while preventing water flow out of the reservoir;

a three-way valve having a first port attached to the reservoir by a dual-function branch, a second port open to atmosphere, and a third port in fluid communication with the source of pressurized air, a valve member of the three-way valve operable between a normal position which establishes communication between the first port and the second port and an actuated position which establishes communication between the first port and the third port;

a second check valve disposed in the dual-function branch and oriented to allow air flow out of the reservoir while preventing water flow out of the reservoir;

a water outlet branch attached to the reservoir and in fluid communication with the toilet bowl, a water discharge valve disposed in the rinse fluid outlet branch and operable between open and closed positions; and a controller for selectively operating the three-way valve and water outlet valve, wherein the three-way valve is initially in the normal position and the water outlet valve is normally in the closed position to allow the reservoir to fill with water, the controller being triggerable to move the three-way valve to the actuated position to thereby pressurize the rinse fluid in the reservoir, the controller also moving the water discharge valve to the open position to send the pressurized water to the toilet bowl.

17. The apparatus of claim 16, in which the controller has a shaft moveable between normal and actuated positions, and the three-way valve has a valve member mechanically actuated by the shaft.

18. The apparatus of claim 17, in which the toilet bowl has an outlet connected to a vacuum source, the water valve is vacuum-operated, and the controller is a pneumatic controller in fluid communication with the vacuum source and operable to transfer vacuum to the water valve.

19. The apparatus of claim 18, further comprising a pneumatic flush button adapted to trigger the controller.

* * * * *